US009016599B2

(12) United States Patent
Johnson et al.

(10) Patent No.: US 9,016,599 B2
(45) **Date of Patent: *Apr. 28, 2015**

(54) WOBBLE ASSEMBLY FOR FLUID PUMPING MECHANISM

(75) Inventors: Harold D. Johnson, Zimmerman, MN (US); Jimmy Wing Sum Tam, Plymouth, MN (US); Bradley H. Hines, Andover, MN (US); Glenn W. Davidson, Roseville, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 514 days.

This patent is subject to a terminal disclaimer.

(21) Appl. No.: 13/255,768

(22) PCT Filed: May 6, 2010

(86) PCT No.: PCT/US2010/001360

§ 371 (c)(1),
(2), (4) Date: Sep. 9, 2011

(87) PCT Pub. No.: WO2010/129064

PCT Pub. Date: Nov. 11, 2010

(65) Prior Publication Data

US 2012/0037726 A1 Feb. 16, 2012

Related U.S. Application Data

(63) Continuation-in-part of application No. PCT/US2009/005740, filed on Oct. 22, 2009.

(60) Provisional application No. 61/176,194, filed on May 7, 2009, provisional application No. 61/107,374, filed on Oct. 22, 2008, provisional application No. 61/143,910, filed on Jan. 12, 2009, provisional application No. 61/251,597, filed on Oct. 14, 2009.

(51) Int. Cl.
*B05B 9/043* (2006.01)
*B05B 9/08* (2006.01)
(Continued)

(52) U.S. Cl.
CPC ..... *B05B 9/0861* (2013.01); *F04B 1/146* (2013.01); *F04B 1/16* (2013.01); *Y10S 239/14* (2013.01)

(58) Field of Classification Search
CPC ..... B05B 9/04; B05B 9/0403; B05B 9/0426; B05B 9/043; B05B 9/0861; B05B 9/0866; B05B 9/0888; F04B 1/146; F04B 1/16
USPC ..... 239/333, 329, 332, 334, 526, DIG. 14
See application file for complete search history.

(56) References Cited

U.S. PATENT DOCUMENTS 2,405,006 A 7/1946 Ashton
2,540,357 A 2/1951 Stanley
(Continued)

FOREIGN PATENT DOCUMENTS

CN 101273198 A 9/2008
DE 2433841 A1 2/1976
(Continued)

OTHER PUBLICATIONS

English Translation of Chinese Office Action, dated Sep. 23, 2013.
(Continued)

*Primary Examiner* — Dinh Q Nguyen
(74) *Attorney, Agent, or Firm* — Kinney & Lange, P.A.

(57) ABSTRACT

A fluid dispensing device comprises a housing body, a reciprocating piston fluid pump, a primary drive element, a wobble assembly and a spray tip. The reciprocating piston fluid pump has a piston disposed within a pumping chamber inside the housing body. The primary drive element is coupled to the housing body to provide a rotary input. The wobble assembly connects the primary drive element to the reciprocating piston fluid pump to convert the rotary input into reciprocating input to the piston. The spray tip connects to an outlet of the pumping chamber.

18 Claims, 15 Drawing Sheets

(51) Int. Cl.
*F04B 1/14* (2006.01)
*F04B 1/16* (2006.01)

(56) References Cited

U.S. PATENT DOCUMENTS

| | | | | |
|---|---|---|---|---|
| 2,629,539 | A | 2/1953 | Drewes | |
| 3,680,981 | A | 8/1972 | Wagner | |
| 4,756,481 | A | 7/1988 | Leuenberger | |
| 4,800,801 | A | 1/1989 | van Zweeden | |
| 5,051,067 | A * | 9/1991 | Terauchi | 417/222.2 |
| 5,137,431 | A * | 8/1992 | Kiyoshi et al. | 417/269 |
| 5,391,058 | A * | 2/1995 | Goto et al. | 417/223 |
| 6,168,093 | B1 | 1/2001 | Greer, Jr. et al. | |
| 2005/0189445 | A1 | 9/2005 | Hartle et al. | |
| 2006/0076434 | A1 | 4/2006 | Hornsby et al. | |
| 2007/0125878 | A1 | 6/2007 | Hahn et al. | |
| 2007/0224358 | A1 | 9/2007 | Insausti-Eciolaza et al. | |
| 2007/0228186 | A1 | 10/2007 | Hornsby et al. | |
| 2009/0068036 | A1 | 3/2009 | Hsu et al. | |

FOREIGN PATENT DOCUMENTS

| | | | |
|---|---|---|---|
| DE | 8713954.5 | U1 | 1/1988 |
| FR | 2307983 | | 11/1976 |
| JP | S57200678 | A | 12/1982 |
| JP | S60178368 | A | 9/1985 |
| JP | S61255280 | A | 11/1986 |
| JP | H01148356 | A | 6/1989 |
| JP | H02500459 | A | 2/1990 |
| JP | H02196173 | A | 8/1990 |
| WO | 2010047800 | A2 | 4/2010 |

OTHER PUBLICATIONS

International Search Report and Written Opinion of Application No. PCT/US2010/001360, filed May 6, 2010.

International Search Report and Written Opinion of Application No. PCT/US2009/005740, filed Oct. 22, 2009.

Japanese Office Action, dated Jan. 22, 2014, for Japanese Patent Application No. 2012-509811, 5 pages.

State Intellectual Property Office of People's Republic of China, The Second Office Action, Jul. 10, 2014, 11 pages.

European Patent Office, European Search Report, Jul. 21, 2014, 6 pages.

Nagato & Partners, Japanese Office Action, Sep. 10, 2014, 6 pages.

* cited by examiner

WOBBLE ASSEMBLY FOR FLUID PUMPING MECHANISM

BACKGROUND

The present invention is related to liquid dispensing systems. In particular, the present invention relates to pumping mechanisms for paint sprayers.

Sprayers are well known and popular for use in painting of surfaces, such as on architectural structures, furniture and the like. Airless paint sprayers provide the highest quality finish amongst common sprayer systems due to their ability to finely atomize liquid paint. In particular, airless paint sprayers pressurize liquid paint to upwards of 3,000 psi [pounds per square inch] (~20.7 MPa) and discharge the paint through small, shaped orifices. Typical airless sprayer systems, however, require a large stationary power unit, such as an electric motor, a gasoline motor or an air compressor, and a large stationary pumping unit to generate such large pressures. The power unit is connected to a stationary paint source, such as a 5 gallon (~18.9 liter) bucket, and a spray gun. These stand units, as they are commonly referred to, are expensive due to heavy duty construction, numerous components and manufacturing costs, but are well suited for painting large areas that require high quality finishes.

It is also desirable to paint smaller areas for which it is not desirable or feasible to set up a stationary stand unit system. For example, it is desirable to provide touch-up and trim areas having finishes that match areas originally painted with a stand unit. Various types of handheld sprayer systems and units have been developed to address such situations. For example, buzz guns or cup guns, as they are commonly referred to, comprise small handheld devices electrically powered by connection to a power outlet. For example, some handheld units use piston pumps that are actuated using crank and rod assemblies or bevel gear assemblies, as described in U.S. Pat. No. 2,488,789 to Williams and U.S. Pat. No. 2,629,539 to Drewes, Jr., respectively. These pumping mechanisms, however, have many intricate parts that increase the cost and size of manufacturing handheld units beyond feasibility.

There is, therefore, a need for a pumping mechanism that, among other things, reduces the expense of manufacturing airless sprayers.

SUMMARY

The present invention is directed to a fluid dispensing device comprising a housing body, a reciprocating piston fluid pump, a primary drive element, a wobble assembly and a spray tip. The reciprocating piston fluid pump has a piston disposed within a pumping chamber inside the housing body. The primary drive element is coupled to the housing body to provide a rotary input. The wobble assembly connects the primary drive element to the reciprocating piston fluid pump to convert the rotary input into reciprocating input to the piston. The spray tip connects to an outlet of the pumping chamber.

DETAILED DESCRIPTION

Figure 1:
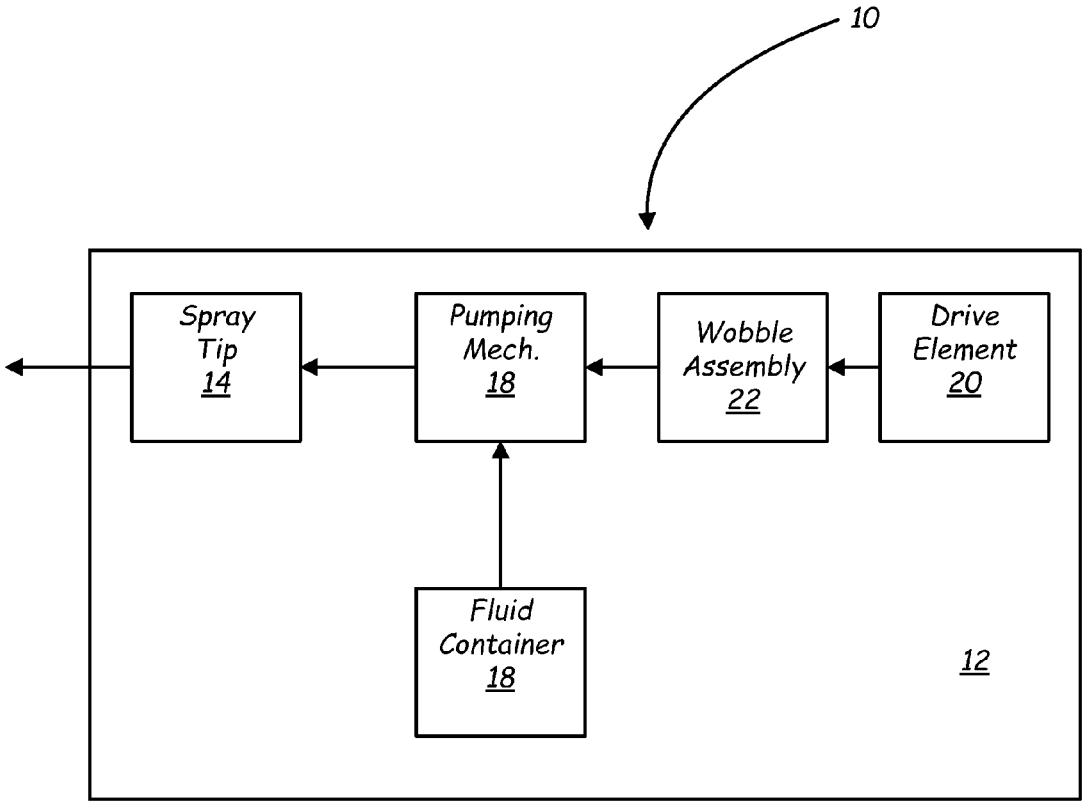
FIG. 1 shows a block diagram of the main components of an airless fluid dispensing device including a wobble assembly of the present invention.
Figure 2:
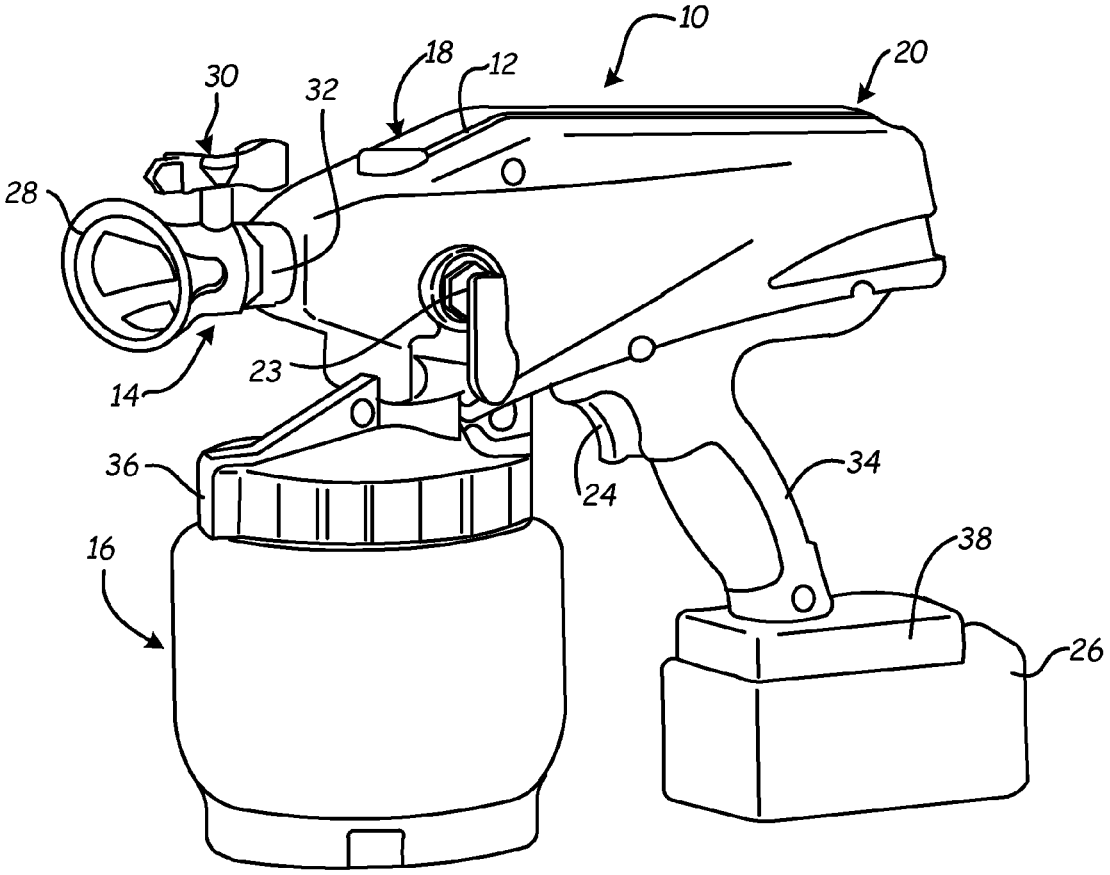
FIG. 2 shows a side perspective view of a handheld sprayer embodiment of the dispensing device of FIG. 1.
Figure 10A:
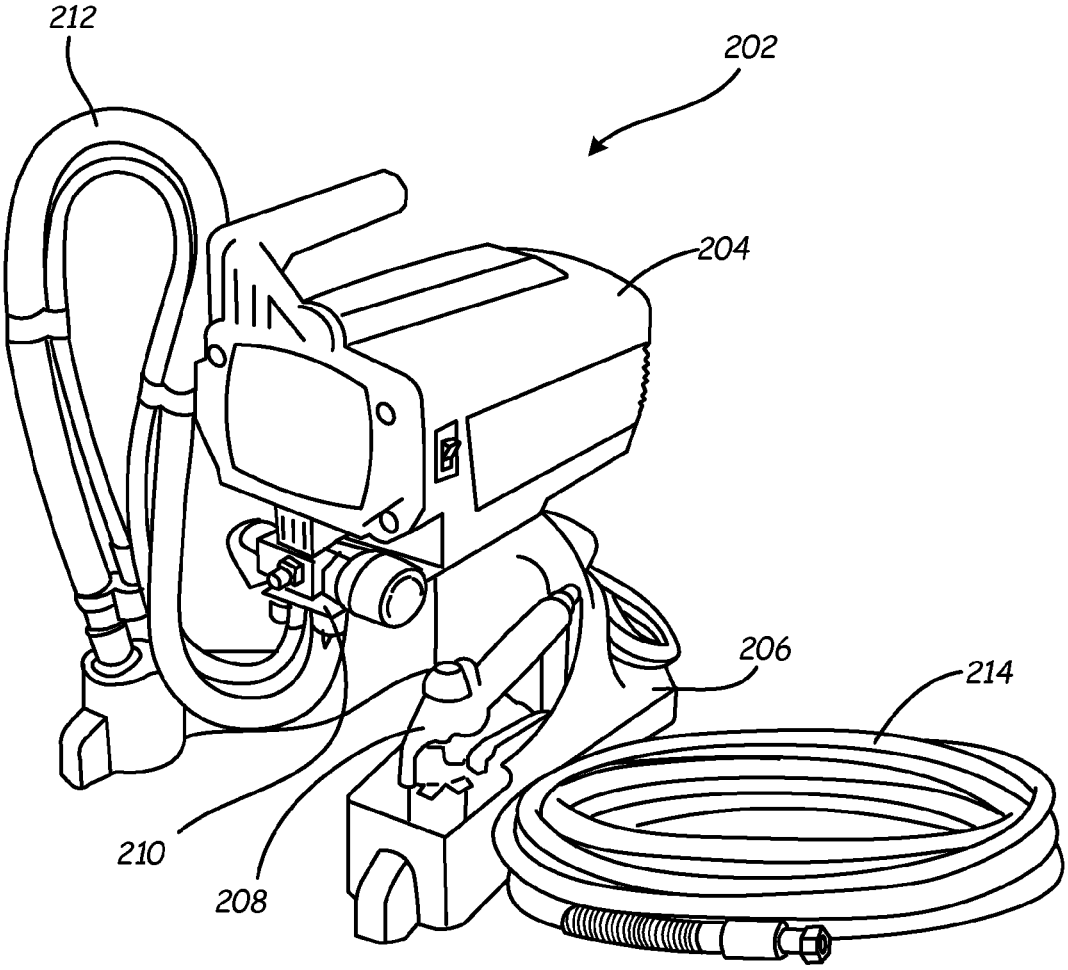
FIG. 10A shows a perspective view of a stand unit airless spraying system in which the wobble assembly of the present invention is used.
Figure 10B:
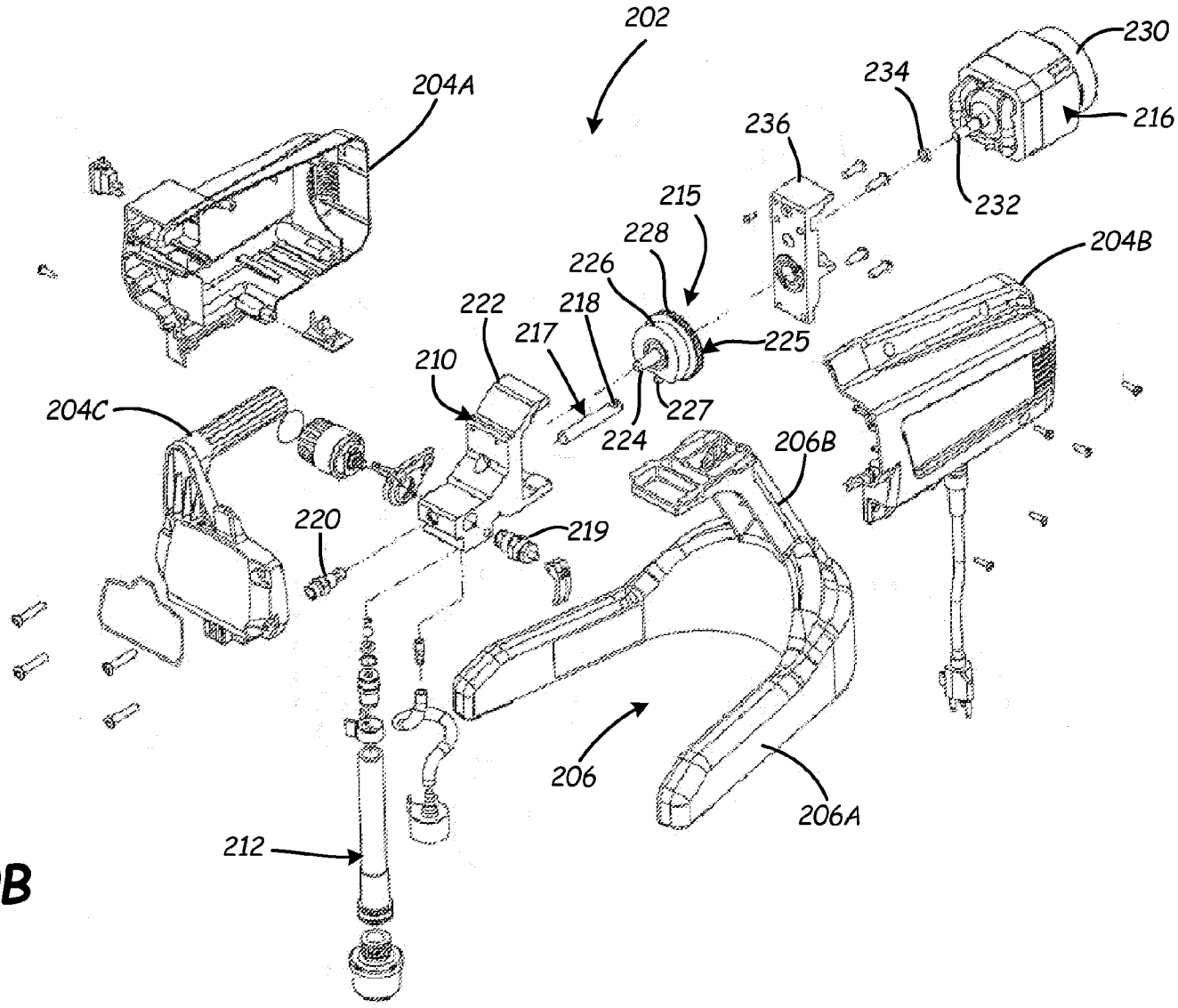
FIG. 10B shows an exploded view of a stand unit airless spraying system in which the wobble assembly of the present invention is used.

FIG. 1 shows a block diagram of airless fluid dispensing device 10 of the present invention. In the embodiment shown, device 10 includes housing 12, spray tip assembly 14, fluid container 16, pumping mechanism 18, drive element 20 and wobble assembly 22. Sprayer 10 comprises an airless dispensing system in which pumping mechanism 18 draws fluid from container 16 and, with power from drive element 20, pressurizes the fluid for atomization through spray tip assembly 14. In various embodiments of the invention, spray tip assembly 14, fluid container 16, pumping mechanism 18, drive element 20 and wobble assembly 22 are packaged together in a stationary or portable spraying system. For example, fluid container 16 can be separated from housing 12 and connected to spray tip assembly 14, pumping mechanism 18 and drive element 20 via a hose. In other embodiments, spray tip assembly 14 can be separated from housing 12 and connected to fluid container 16, pumping mechanism 18 and drive element 20 via a hose, to form a stand unit system as shown in FIGS. 10A and 10B. As shown in FIG. 2, spray tip assembly 14, fluid container 16, pumping mechanism 18, drive element 20 and wobble assembly 22 can also be mounted directly to housing 12 to comprise an integrated handheld spray gun device. In the disclosed embodiment, pumping mechanism 18 comprises a reciprocating piston pump and drive element 20 comprises an electric motor that drives pumping mechanism 18 through wobble assembly 22 of the present invention.

FIG. 2 shows a side perspective view of spray gun 10 having housing 12, spray tip assembly 14 and fluid container 16. Pumping mechanism 18, drive element 20 and wobble assembly 22 (FIG. 1) are disposed within housing 12. Spray gun 10 also includes pressure relief valve 23, trigger 24 and battery 26. Spray tip assembly 14 includes guard 28, spray tip 30 and connector 32. Housing 12 includes integrated handle 34, container lid 36 and battery port 38.

Fluid container 16 is provided with a fluid that is to be sprayed from spray gun 10. For example, fluid container 16 is filled with a paint or varnish that is fed to spray tip assembly 14 through coupling with lid 36. Battery 26 is plugged into battery port 38 to provide power to drive element 20 within housing 12. Trigger 24 is electrically connected to battery 26 and drive element 20 such that upon actuation of trigger 24 a power input is provided to pumping mechanism 18. Trigger 24 is disposed in handle 34, which comprises a pistol grip-type handle. Pumping mechanism 18 draws fluid from container 16 and provides pressurized fluid to spray tip assembly 14. Connector 32 couples spray tip assembly 14 to pump 18 at an outlet port of housing 12. Tip guard 28 is connected to connector 32 to prevent objects from contacting high velocity fluid output from spray tip 30. Spray tip 30 is inserted through bores within tip guard 28 and connector 32 and includes a spray orifice that receives pressurized fluid from pumping mechanism 18, which is powered by drive element through wobble assembly 22. Spray tip assembly 14 provides a highly atomized flow of fluid to produce a high quality finish. Pressure relief valve 23 is connected to pumping mechanism 18 to open the mechanism to atmospheric pressure.

Figure 3:
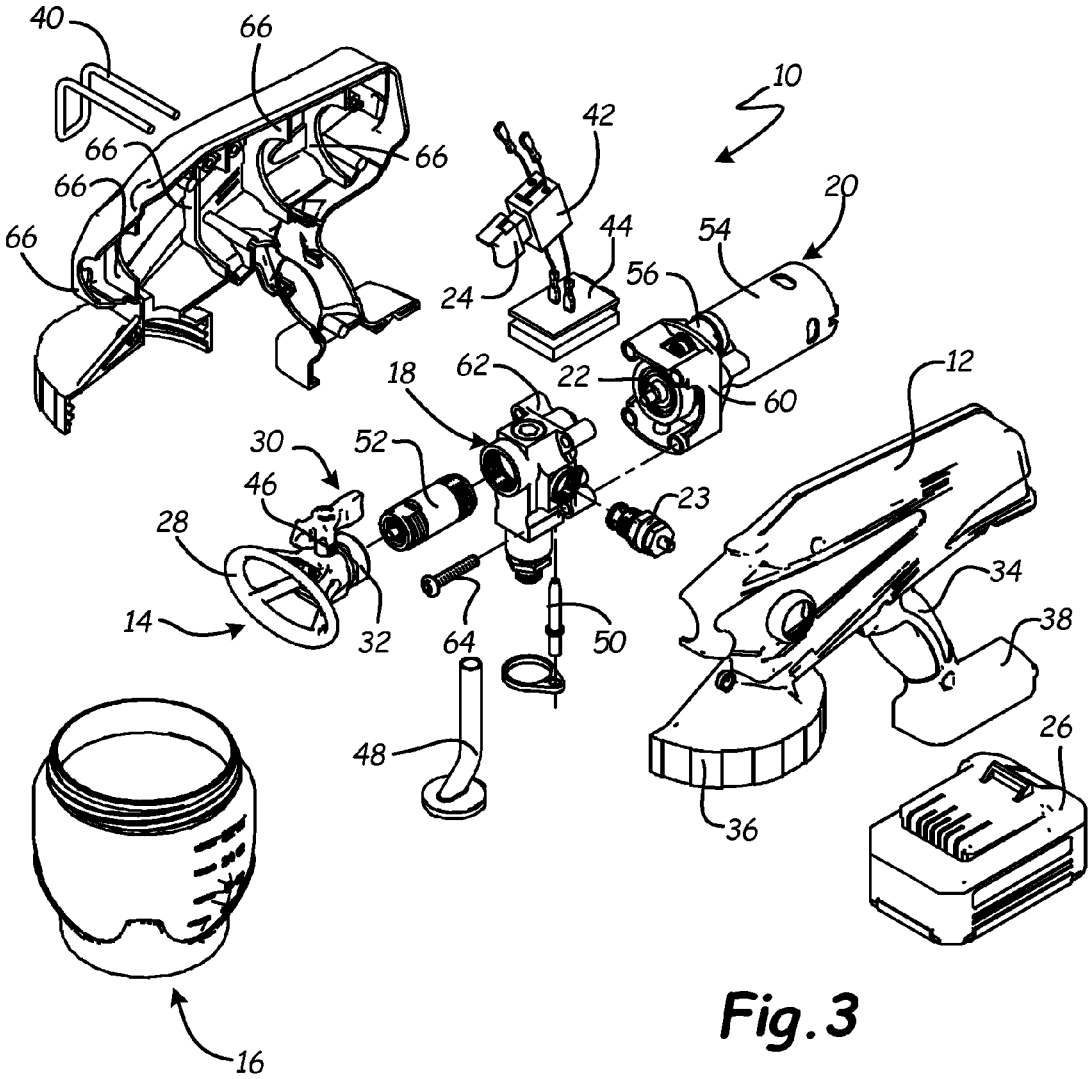
FIG. 3 shows an exploded view of the handheld sprayer of FIG. 2, showing a housing, a spray tip assembly, a fluid cup, a pumping mechanism, a wobble assembly and a drive element.

FIG. 3 shows an exploded view of spray gun 10 having housing 12, spray tip assembly 14, fluid container 16, pumping mechanism 18, drive element 20 and wobble assembly 22. Spray gun 10 also includes pressure relief valve 23, trigger 24, battery 26, clip 40, switch 42 and circuit board 44. Spray tip assembly 14 includes guard 28, spray tip 30, connector 32 and barrel 46. Pumping mechanism 18 includes suction tube 48, return line 50 and valve 52. Drive element 20 includes motor 54 and gearing assembly 56, which connects to wobble assembly 22. Housing 12 includes integrated handle 34, container lid 36 and battery port 38.

Pumping mechanism 18, drive element 20, wobble assembly 22, gearing 56 and valve 52 are mounted within housing 12 and supported by various brackets. For example, gearing 56 and wobble assembly 22 include bracket 60 which connects to bracket 62 of pumping mechanism 18 using fasteners 64. Valve 52 is threaded into bracket 62, and connector 32 of spray tip 30 is threaded onto valve 52. Spray tip 30, valve 52, pumping mechanism 18 and drive element 54 are supported within housing 12 by ribs 66. In other embodiments of spray gun 10, housing 12 includes ribs or other features for directly supporting gearing 56 and wobble assembly 22 without the use of bracket 60, as shown in FIGS. 11-14. Switch 42 is positioned above handle 34 and circuit board 44 is positioned below handle 34 such that trigger 24 is ergonomically positioned on housing 12. Switch 42 includes terminals for connecting with drive element 20, and battery 26 is supported by port 38 of housing 12 in such a manner so as to connect with circuit board 44. In exemplary embodiments, circuit board 44 is programmed to control voltage supplied to drive element 20 to vary flow from pumping mechanism 18. Battery 26 may comprise a Lithium battery, a Nickel battery, a Lithium-ion battery or any other suitable rechargeable battery. Fluid container 16 is threaded into lid 36 of housing 12. Suction tube 48 and return line 50 extend from pumping mechanism 18 into fluid container 16. Clip 40 allows gun 10 to be conveniently stowed such as on a belt of an operator or a storage rack.

To operate gun 10, fluid container 16 is filled with a liquid to be sprayed from spray tip 30. Trigger 24 is actuated by an operator to activate drive element 20. Drive element 20 draws power from battery 26 and causes rotation of a shaft connected to gearing 56. Gearing 56 causes wobble assembly 22 to provide an actuation motion to pumping mechanism 18. In particular, wobble assembly 22 converts rotational power of drive element 20 into reciprocating power for pumping mechanism 18.

Pumping mechanism 18 draws liquid from container 16 using suction tube 48. Excess fluid not able to be processed by pumping mechanism 18 is returned to container 16 through priming valve 23 and return line 50. Pressurized liquid from pumping mechanism 18 is provided to valve 52. Once a threshold pressure level is achieved, valve 52 opens to allow pressurized liquid into barrel 46 of spray tip 30. Barrel 46 includes a spray orifice that atomizes the pressurized liquid as the liquid leaves spray tip 30 and gun 10. Barrel 46 may comprise either a removable spray tip that can be removed from tip guard 28, or a reversible spray tip that rotates within tip guard 28.

Figure 4:
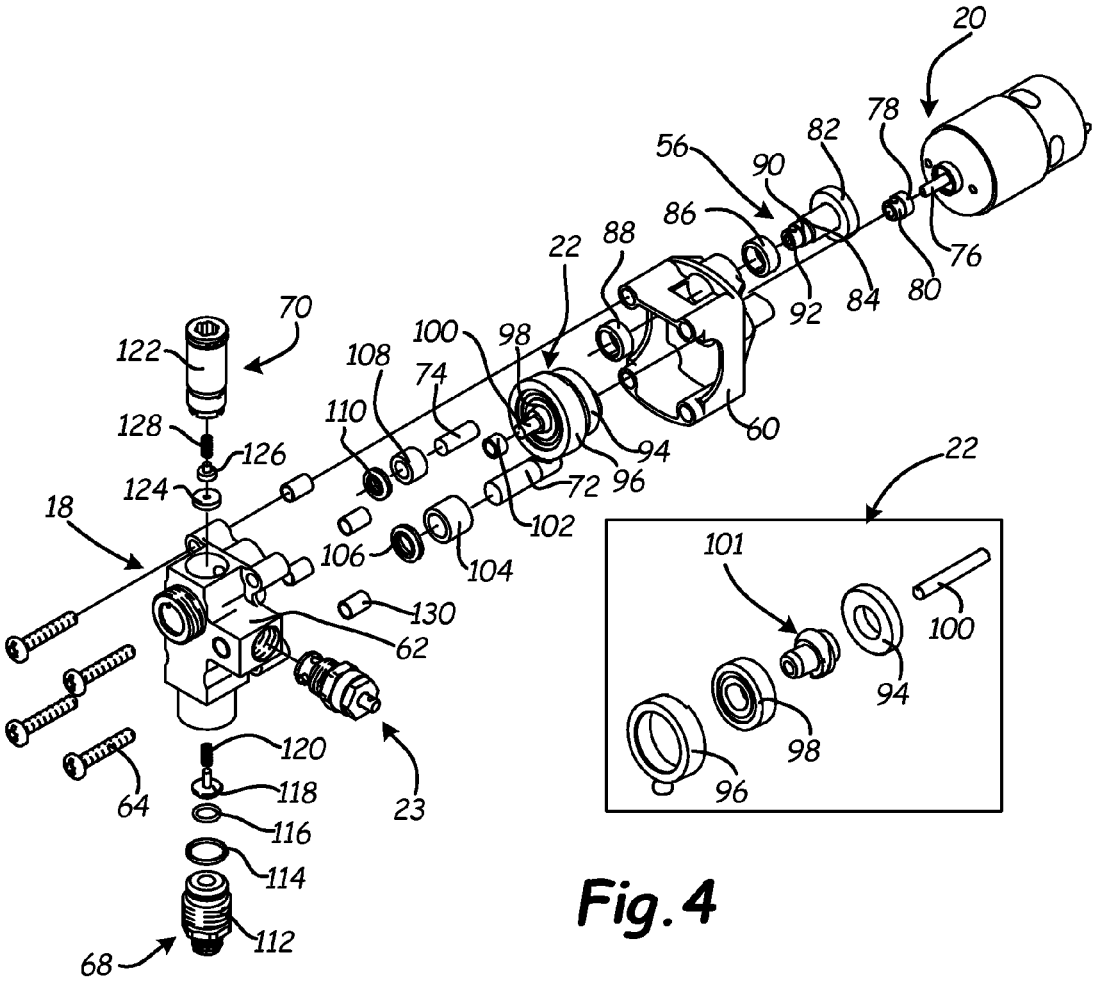
FIG. 4 shows an exploded view of the pumping mechanism, wobble assembly and drive element of FIG. 3.

FIG. 4 shows an exploded view of pumping mechanism 18, drive element 20 and wobble assembly 22 of FIG. 3. Pumping mechanism 18 includes bracket 62, fasteners 64, inlet valve assembly 68, outlet valve assembly 70, first piston 72 and second piston 74. Drive element 20 includes drive shaft 76, first gear 78, first bushing 80, second gear 82, shaft 84, second bushing 86, third bushing 88, third gear 90, fourth bushing 92 and fourth gear 94. Wobble assembly 22 includes connecting rod 96, bearing assembly 98, pin 100, hub 101 and sleeve 102. First piston 72 includes first piston sleeve 104 and first piston seal 106. Second piston 74 includes second piston sleeve 108 and second piston seal 110. Inlet valve 68 includes first valve cartridge 112, seal 114, seal 116, first valve stem 118 and first spring 120. Outlet valve 70 includes second valve cartridge 122, seat 124, second valve stem 126 and second spring 128.

Drive shaft 76 is inserted into bushing 80 such that gear 78 rotates when drive element 20 is activated. In various embodiments of the invention, bushing 80 and gear 78 are integrally formed as one component. Bushings 86 and 88 are inserted into a receiving bore within bracket 60, and shaft 84 is inserted into bushings 86 and 88. Gear 82 is connected to a first end of shaft 84 to mesh with gear 78, and gear 90 is connected with a second end of shaft 84 to mesh with gear 94. In various embodiments of the invention, gear 82, shaft 84, gear 90 and bushing 92 are integrally formed as one component. Sleeve 102 is inserted into a receiving bore within bracket 62, and pin 100 is inserted into sleeve 102 to support wobble assembly 22. Wobble assembly 22 uses a few easily manufactured and assembled components to complete power transmission between drive element 20 and pumping mechanism 18.

Bearing assembly 98 connects pin 100 to connecting rod 96. Connecting rod 96 couples with first piston 72. First piston 72 and second piston 74 are inserted into piston sleeves 102 and 108, respectively, which are mounted within pumping chambers within bracket 62. Valve seal 106 and sleeve 108 seal the pumping chambers. Fasteners 64 are inserted through bores in bracket 62 and bushings 130 and threaded into bracket 60. First valve cartridge 112 is inserted into a receiving bore in bracket 62. First spring 120 biases valve stem 128 against cartridge 112. Similarly, second valve cartridge 122 is inserted into a receiving bore in bracket 62 such that second spring 128 biases valve stem 126 against bracket 62. Valve cartridges 112 and 122 are removable from bracket 62 such that valve stems 118 and 126 can be easily replaced. Seals 114 and 116 prevent fluid from leaking out of valve 68, and seat 124 prevents fluid from leaking out of valve 70. Valve 23 is inserted into a receiving bore in bracket 62 to intersect fluid flow from pistons 72 and 74.

Figure 5:
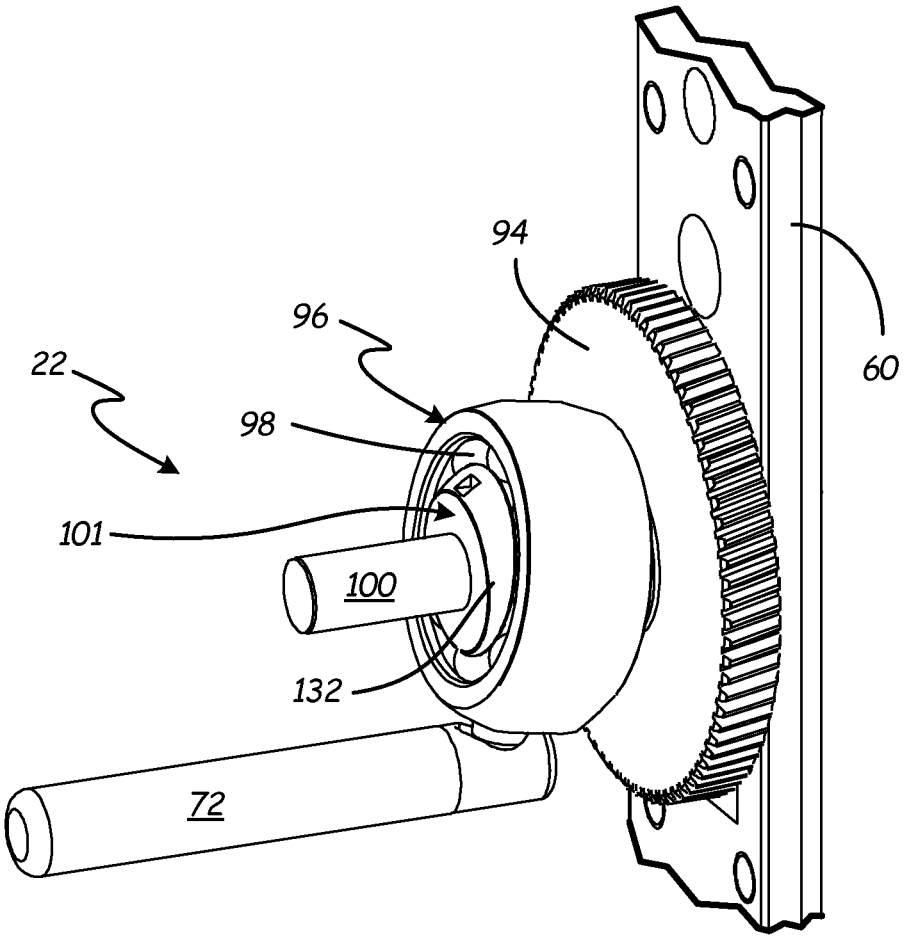
FIG. 5 shows a perspective view of a wobble assembly having a pin supporting a hub and connecting rod assembly used with the drive element and pumping mechanism of FIG. 4.
Figure 6B:
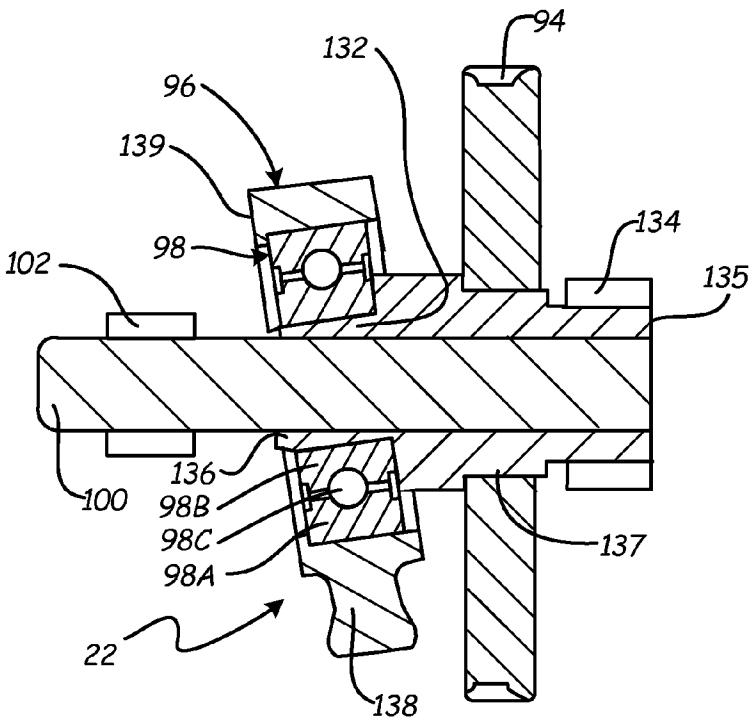
FIG. 6B shows a cross-sectional view of the wobble assembly of FIG. 5 with a connecting rod in a retracted position.
Figure 6A:
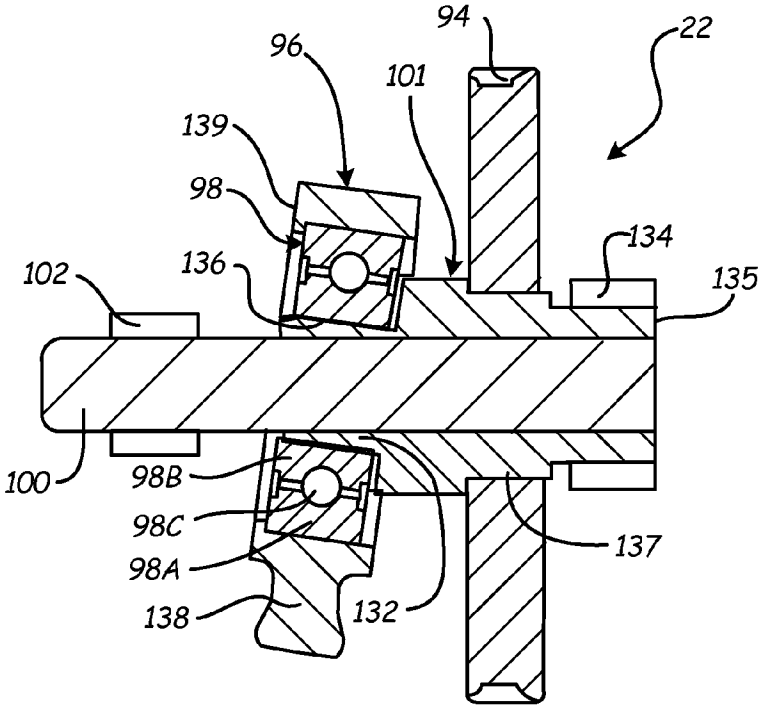
FIG. 6A shows a cross-sectional view of the wobble assembly of FIG. 5 with a connecting rod in an advanced position.
Figure 12:
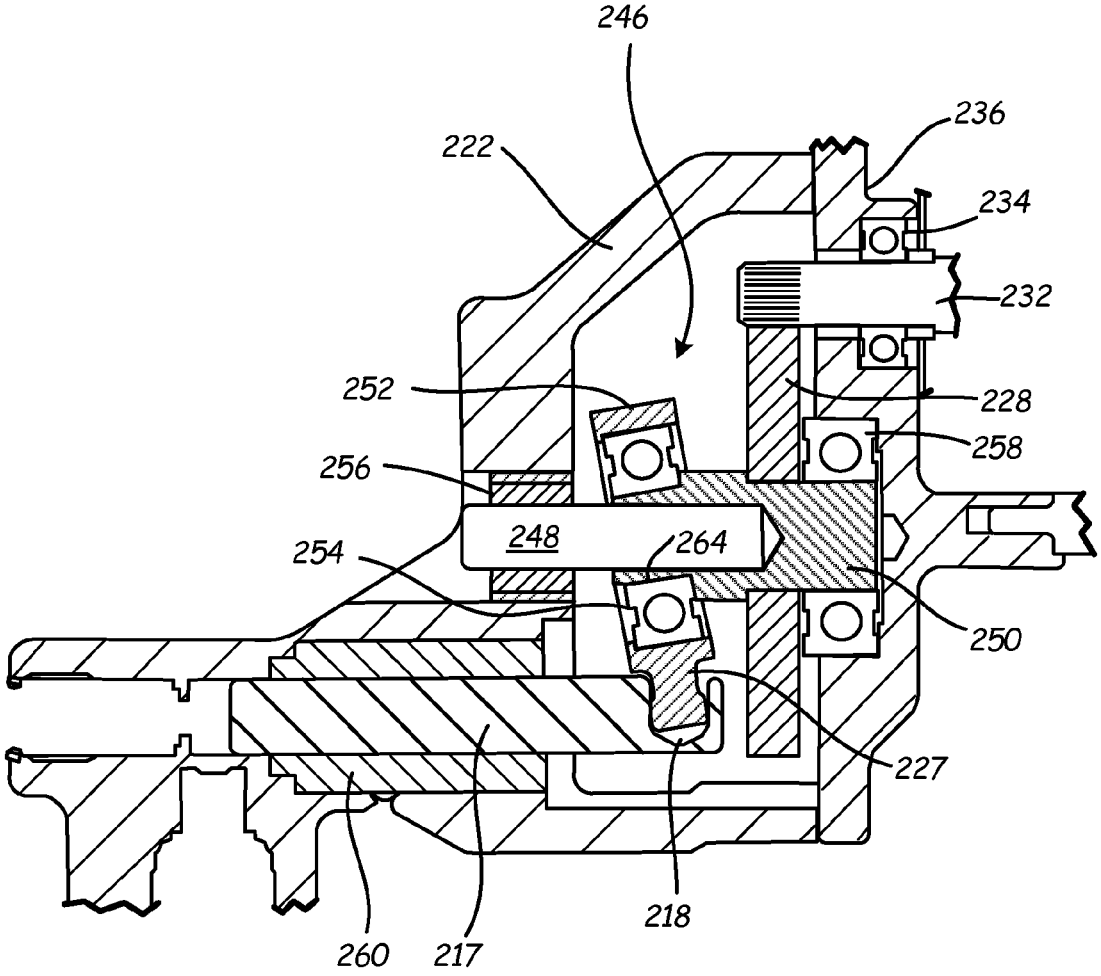
FIG. 12 shows a cross-sectional view of a wobble assembly having a pin and hub assembly supporting a connecting rod assembly
Figure 13:
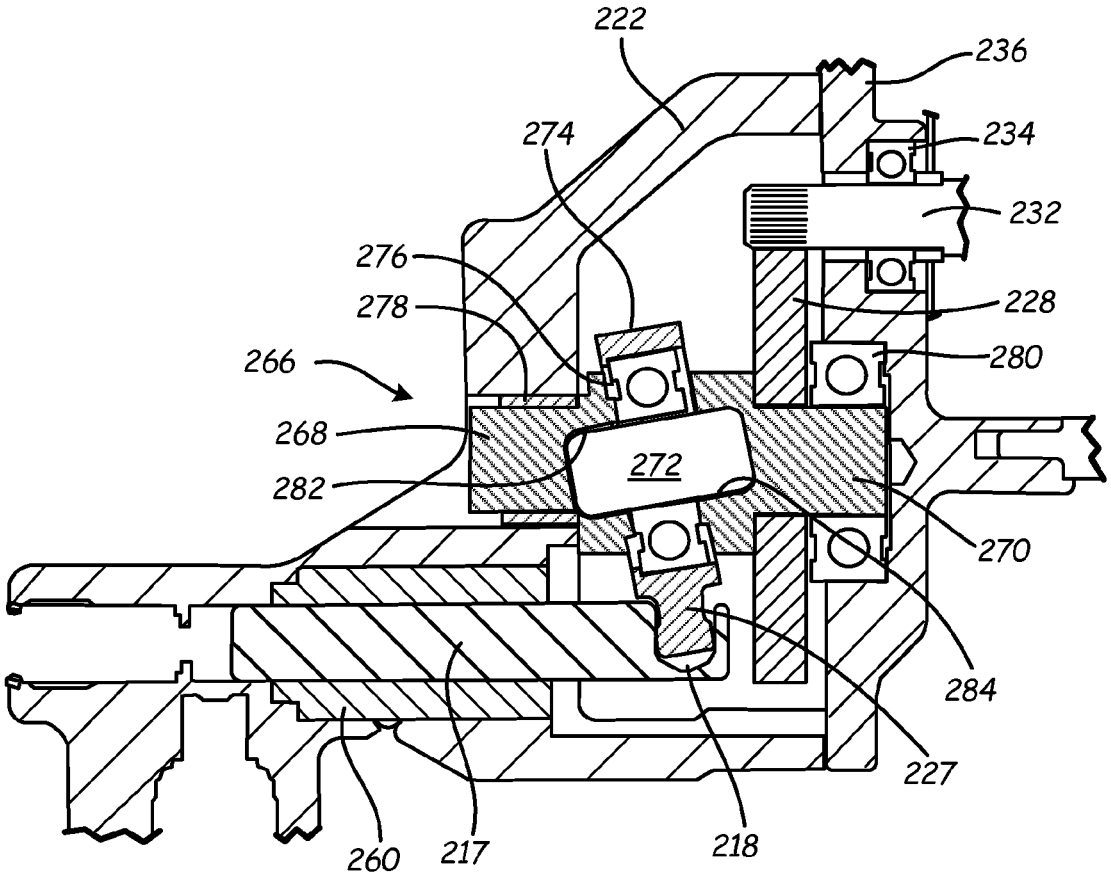
FIG. 13 shows a cross-sectional view of a wobble assembly having hub ends supporting a dowel and a connecting rod assembly.
Figure 14:
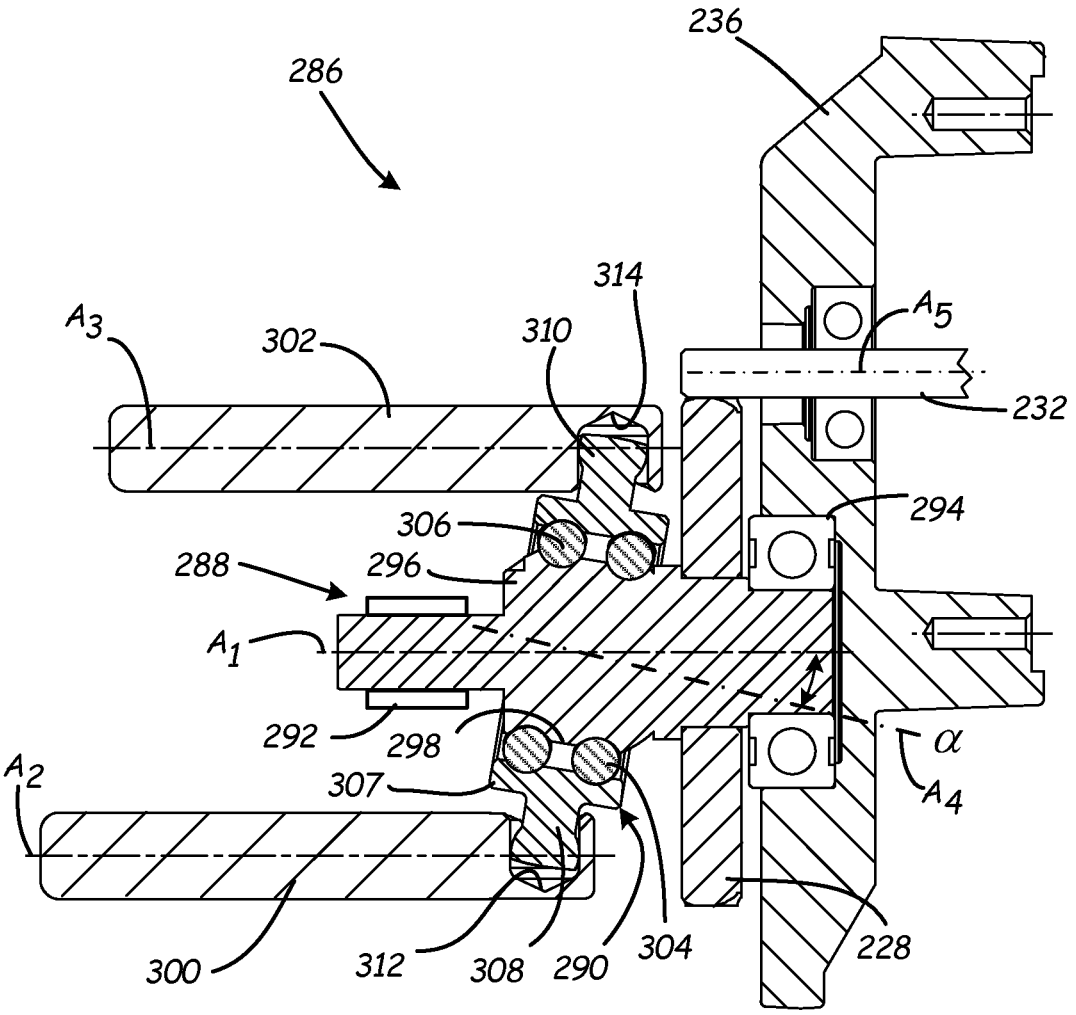
FIG. 14 shows a cross-sectional view of a wobble assembly having a single-piece shaft and hub supporting a connecting rod assembly for driving two pistons through two sets of integrated bearings.

FIG. 5 shows a perspective view of wobble assembly 22 of FIG. 4. Wobble assembly 22 includes pin 100, upon which hub 101, bearing assembly 98, connecting rod 96 and gear 94 are attached. Wobble assembly 22 provides a connection between drive element 20 and pumping mechanism 18. Piston 72 is connected to connecting rod 96 by a ball and socket, or plug and protrusion, arrangement. Wobble assembly 22 converts rotational shaft power from drive element 20 to reciprocating motion for piston 72. As is better illustrated in FIGS. 6A and 6B, rotation of pin 100 via gear 94 produces wobble of connecting rod 96 through land 132, which has a surface with an offset axis of rotation. Pin 100 and hub 101 are arranged to form a shaft for connecting rod 96, as shown in FIGS. 6A and 6B. FIG. 12 shows an alternative arrangement of a pin and hub shaft assembly. In various embodiments of the invention, the shaft can be comprised of a hub and dowel configuration, as shown in FIG. 13. In yet other embodiments, the shaft is integrally formed as one component, as shown in FIG. 14.

FIG. 6A shows a cross-sectional view of wobble assembly 22 of FIG. 5 with connecting rod 96 in an advanced position. FIG. 6B shows a cross-sectional view of wobble assembly 22 of FIG. 5 with connecting rod 96 in a retracted position. Wobble assembly 22 includes gear 94, connecting rod 96, bearing assembly 98, pin 100, hub 101, sleeve 102 and bushing 134. Hub 101 includes land 132, bushing seat 135, wobble seat 136 and gear seat 137. FIGS. 6A and 6B, which are discussed concurrently, illustrate the reciprocating motion generated by land 132 when subjected to rotational movement. Pin 100 is supported at a first end by sleeve 102, which is supported in bracket 62 of pumping mechanism 18. Pin 100 is supported at a second end, through hub 101, by bushing 134, which is supported in bracket 60. Sleeve 102 and bushing 134 comprise bearings that facilitate rotation of pin 100. In other embodiments, other types of bearings, such as rolling element bearings, may be used. Hub 101 is disposed about pin 100 and includes bushing seat 135 for bushing 134, gear seat 137 for gear 94, and land 132. Land 132 includes wobble seat 136 for connecting rod 96. Connecting rod 96 includes ball 138, which is disposed in a socket within piston 72, and yoke 139.

Bearing assembly 98 includes outer race 98A, inner race 98B and bearing set 98C. Outer race 98A adjoins an inner surface of yoke 139. Inner race 98B adjoins an outer surface of wobble seat 136. Outer race 98A and inner race 98B include troughs, such as hemispherical or v-shaped troughs, in which bearing set 98C is disposed. Bearing set 98C comprises a plurality of ball bearings configured to roll between outer and inner races 98A and 98C. Outer race 98A, inner race 98B and bearing set 98C comprise an assembled unit such that bearing assembly 98 is preassembled. Bearing assembly 98 can then be press fit around wobble seat 136 and yoke 139 can be press fit around bearing assembly 98. In other embodiments, a bearing can be integrated into connecting rod 96 and land 132, similar to what is shown in FIG. 14.

Gear 94 rotates land 132 and pin 100, which rotates within sleeve 102 and bushing 134. Wobble seat 136 comprises a cylindrical-like structure having a surface revolved about an axis that is offset or tilted at an angle from the axis about which hub 101 and pin 100 rotate. As hub 101 revolves, the axis of land 132 orbits the axis of pin 100, making a cone-like sweep. Bearing assembly 98 is disposed in a plane transverse to the axis of wobble seat 136. As such, bearing assembly 98 undulates, or wobbles, with respect to a plane transverse to pin 100. Connecting rod 96 is connected to the outer diameter end of bearing assembly 98, but is prevented from rotating about pin 100 by ball 138. Ball 138 is connected to piston 72, which is disposed within a piston seat in bracket 62 such that rotation is prevented. Ball 138 is, however, permitted to move in the axial direction as bearing 138 wobbles. Thus, rotational motion of wobble seat 136 produces linear motion of ball 138 to drive pumping mechanism 18.

Figure 7:
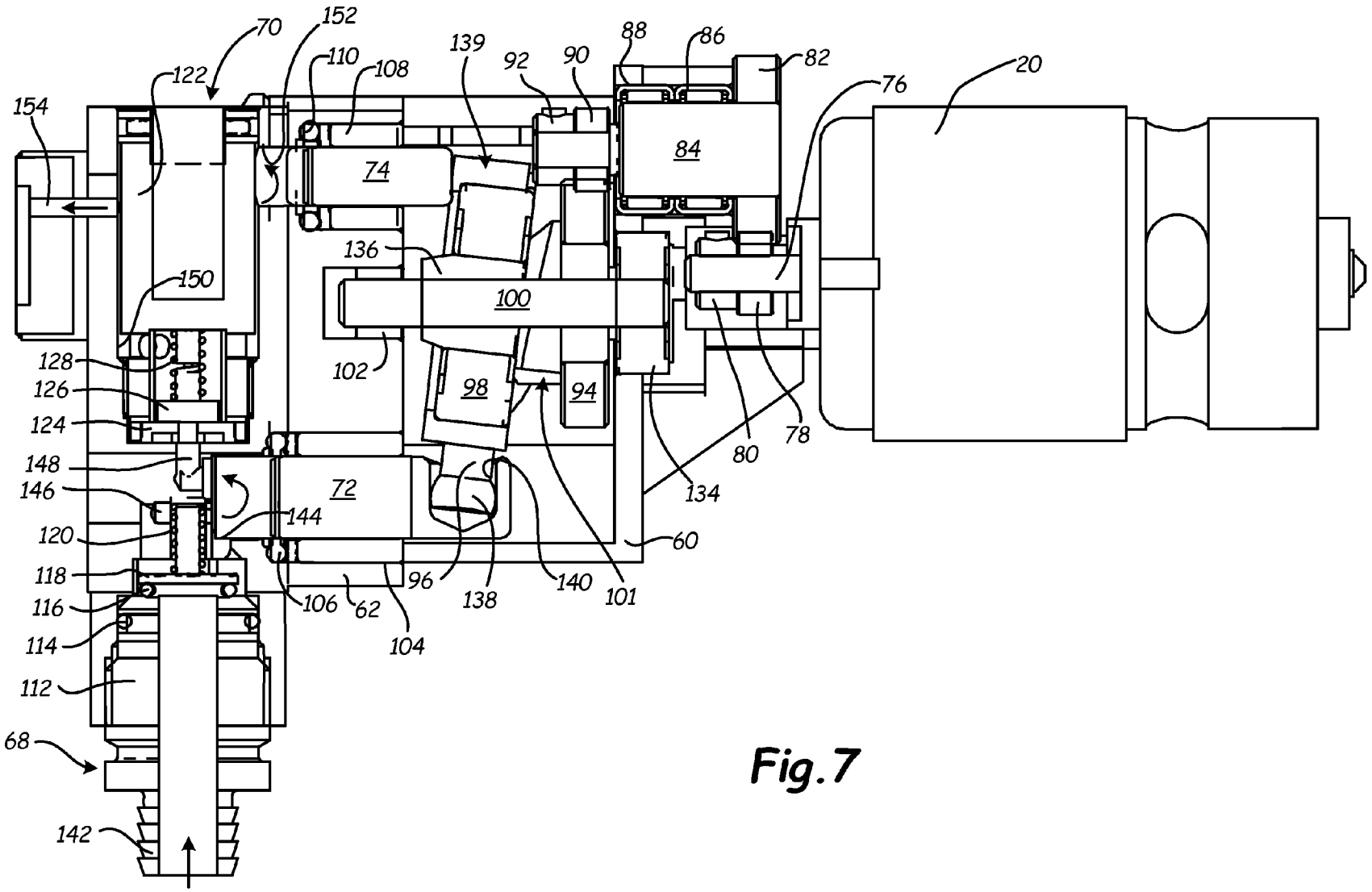
FIG. 7 shows a cross-sectional view of an assembled pumping mechanism, wobble assembly and drive element.

FIG. 7 shows a cross-sectional view of pumping mechanism 18 assembled with drive element 20. Drive element 20 comprises a mechanism or motor for producing rotation of drive shaft 76, such as a DC (direct current) motor that receives electrical input from battery 26. In other embodiments drive element may comprise an AC (alternating current) motor that receives electrical input by plugging into a power outlet, or a pneumatic motor that receives compressed air as an input. First gear 78 is fit over drive shaft 76 and is held in place by bushing 80. Bushing 80 is secured to shaft 76 using a setscrew or another suitable means.

First gear 78 meshes with second gear 82, which is connected to shaft 84. Shaft 84 is supported in bracket 62 by bushings 86 and 88. Gear 90 is disposed on a reduced diameter portion of shaft 84 and secured in place using bushing 92. Bushing 92 is secured to shaft 84 using a setscrew or another suitable means. Gear 90 meshes with gear 94 to rotate pin 100. Pin 100 is supported by sleeve 102 and bushing 134 in brackets 62 and 60, respectively. Gears 78, 82, 90 and 94 provide a gear reduction means that slows the input to pin 100 from the input provided by drive element 20. Depending on the type of pumping mechanism used and the type of drive element used, various sizes of gears and gear reductions can be provided as is needed to produce the desired operation of pumping mechanism 18.

As is described with respect to FIGS. 6A and 6B, rotation of pin 100 produces linear motion of ball 138 of connecting rod 96. Ball 138 is mechanically connected to socket 140 of piston 72. Thus, connecting rod 96 directly actuates piston 72 in both advanced and retracted positions. Piston 72 advances and retracts within piston sleeve 104 in bracket 62. As piston 72 retreats from the advanced position, fluid is drawn into valve 68. Valve 68 includes stem 142 to which suction tube 48 connects. Suction tube 48 is submerged within a liquid inside fluid container 16 (FIG. 3). The liquid is drawn into pumping chamber 144 around valve stem 118 and through inlet 146. Valve stem 118 is biased against valve cartridge 112 by spring 120. Seal 116 prevents fluid from passing between cartridge 112 and stem 118 when stem 118 is closed. Seal 114 prevents fluid from passing between cartridge 112 and bracket 62. Valve stem 118 is drawn away from cartridge 112 by suction produced by piston 72. As piston 72 advances, fluid within pumping chamber 144 is pushed through outlet 148 toward valve 70.

Fluid pressurized in chamber 144 is pushed into pressure chamber 150 around valve stem 126 of valve 70. Valve stem 126 is biased against bracket 62 by spring 128. Seat 124 prevents fluid from passing between stem 126 and bracket 62 when stem 126 is closed. Valve stem 126 is forced away from bracket 62 as piston 72 moves toward the advanced position, as spring 120 and the pressure generated by piston 72 closes valve 68. Pressurized fluid from pumping chamber 144 fills pressure chamber 150, comprising the space between cartridge 122 and bracket 62, and pumping chamber 152. The pressurized fluid also forces piston 74 to the retracted position. Cartridge 122 reduces the volume of pressure chamber 150 such that less fluid is stored within pumping mechanism 18 and the velocity of fluid being passed through mechanism 18 is increased, which assists in clean up. The volume of pumping chamber 144 and the displacement of piston 72 is larger than the displacement of piston 74 and the volume of pumping chamber 152. As such, a single stroke of piston 72 provides enough fluid to fill pumping chamber 152 and maintain pressure chamber 150 filled with pressurized fluid. Additionally, piston 72 has a large enough volume to push pressurized fluid through outlet 154 of bracket 62. Providing suction from only a single, larger piston provides improved suction capabilities over providing suction by two smaller pistons. In other embodiments, each of pistons 72 and 74 directly draws fluid from fluid container 16 for pressurizing pressure chamber 150.

As piston 72 retreats to draw additional fluid into pumping chamber 144, piston 74 is pushed forward by an upper portion of the front surface of yoke 139 of connecting rod 96. Piston 74 is disposed within piston sleeve 108 in bracket 62, and piston seal 110 prevents pressurized fluid from escaping pumping chamber 152. Piston 74 advances to evacuate fluid pushed into pumping chamber 152 by piston 72. The fluid is pushed back into pressure chamber 150 and through outlet 154 of bracket 62. Subsequently, piston 74 retreats within pumping chamber 152 by the force of piston 72 forcing pressurized fluid back into pumping chamber 152, avoiding the need for spring return mechanisms. Piston 72 and piston 74 operate out of phase with each other. For the specific embodiment shown, piston 74 is one-hundred eighty degrees out of phase with piston 74 such that when piston 74 is at its most advanced position, piston 72 is at its most retracted position. Operating out of phase, pistons 72 and 74 operate in synch to provide a continuous flow of pressurized liquid to pressure chamber 150 while also reducing vibration in sprayer 10. Pressure chamber 150 acts as an accumulator to provide a constant flow of pressurized fluid to outlet 154 such that a continuous flow of liquid can be provided to valve 52 and spray tip assembly 14 (FIG. 3).

Figure 8:
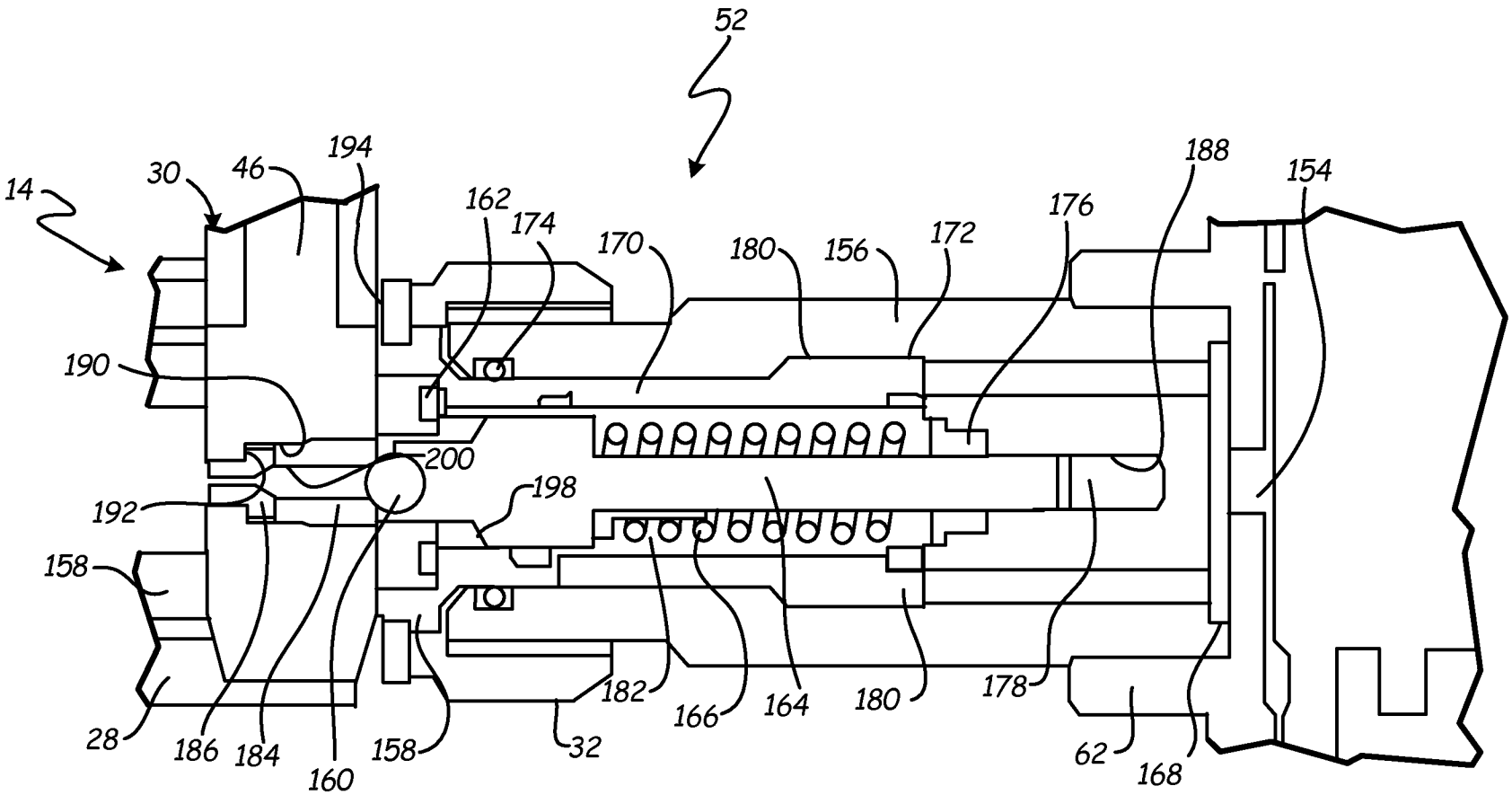
FIG. 8 shows a side cross-sectional view of a valve of the spray tip assembly of FIG. 3.
Figure 9:
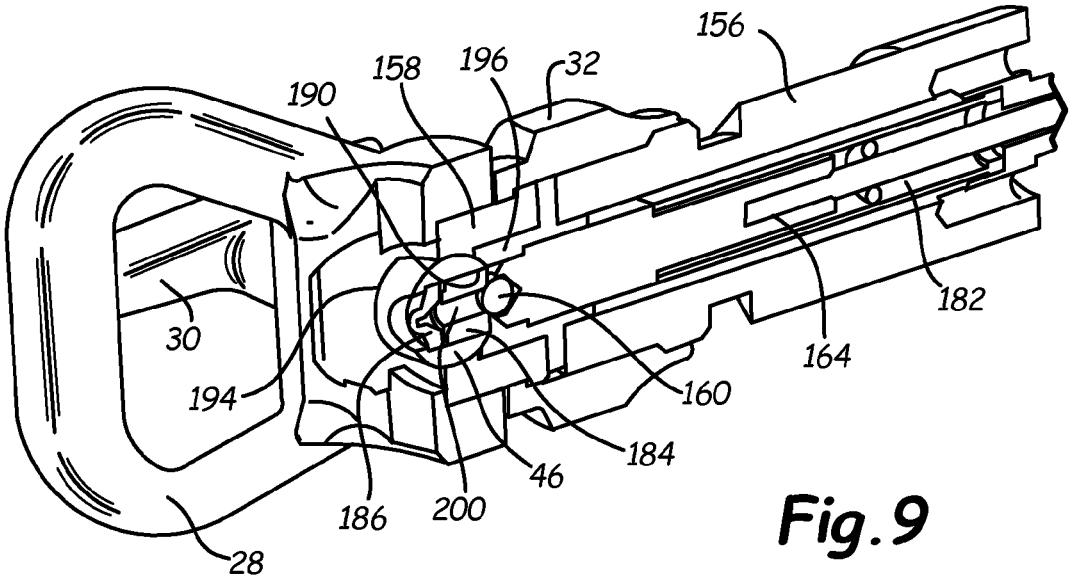
FIG. 9 shows a bottom cross-sectional view of the valve of FIG. 8.

FIG. 8 shows a side cross-sectional view of valve 52 and spray tip assembly 14. FIG. 9, which is discussed concurrently with FIG. 8, shows a bottom cross-sectional view of valve 52 and spray tip assembly 14. Valve 52 includes cylinder 156, cap 158, ball tip 160, seal 162, needle 164, spring 166, seal 168, spring dampers 170 and 172, seal 174, seal 176, stopper 178, fluid passage 180 and filter 182. Spray tip assembly 14 includes guard 28, connector 32, spray tip 30, which includes barrel 46, seat 184 and spray orifice 186.

Cylinder 156 of valve 52 is threaded into a socket within bracket 62 of pumping mechanism 18. Seal 168 prevents fluid from leaking between bracket 62 and cylinder 156. Spring damper 172, spring 166 and spring damper 170 are positioned around needle 164, and filter 182 is positioned around needle 164 and spring 166. Stopper 178 is inserted into axial bore 188 within cylinder 156. Needle 164 and filter 182 are inserted into cylinder 156 and needle 164 extends into axial bore 188 within cylinder 156. Seal 176 prevents fluid from leaking into the axial bore within cylinder 156. Filter 182 connects cap 158 with cylinder 156 to extend fluid passage 180 in an annular flow path toward cap 158. Cap 158 is inserted into fluid passage 180 of cylinder 156. Seal 174 prevents fluid from leaking between cylinder 156 and cap 158. Seal 162 is inserted into cap 158 to surround integrated ball tip 160 of needle 164. Connector 32 is threaded onto cylinder 156 to maintain seal 162 engaged with cap 158 and needle 164 disposed within cylinder 156.

Spray orifice 186 is inserted into bore 190 within barrel 46 of spray tip 30 and abuts shoulder 192. Seat 184 is inserted into bore 190 and maintains orifice 186 against shoulder 192. Spray tip 30 is inserted into transverse bore 194 in cap 158 such that seat 184 aligns with needle 164. Ball tip 160 is biased against seat 184 by spring 166. Seat 184 includes a contoured surface for engaging ball tip 160 such that flow of pressurized fluid is prevented from entering spray tip 30. Guard 28 is positioned around cap 158.

Upon activation of pumping mechanism 18, such as by operation of trigger 24, pressurized fluid is provided to outlet 154. Fluid from pumping mechanism 18 is pushed into valve 52 through outlet 154. The fluid travels through fluid passage 180, around filter 182, to engage cap 158. At cap 158, the pressurized fluid is able to pass between cap 158 and needle 164 at passage 196 (as shown in FIG. 9) so as to be positioned between seal 162 and land 198 of needle 164. The pressure of the fluid against land 198, and other forward facing surfaces of needle 164, forces needle 164 to retract within cylinder 156. Spring 166 compresses between dampers 170 and 172, which inhibit spring 166 from vibrating during pulsation of the pressurized fluid from pumping mechanism 18. Stopper 178 inhibits needle 164 from moving too far and reduces the impact of needle 164 against cylinder 156. With needle 164 retracted, pressurized fluid is able to pass through seal 162 and into bore 200 of seat 184. From bore 200, the pressurized fluid is atomized by orifice 186.

In other embodiments of the invention, valve 52 may comprise an assembly in which seat 184 is integrated into cylinder 156, as is shown and discussed in the above-referenced PCT Application No. PCT/US2009/005740. For example, a pressure actuated shutoff valve may be used, such as a Cleanshot™ shutoff valve available from Graco Minnesota Inc., Minneapolis, Minn. Such valves are described in U.S. Pat. No. 7,025,087 to Weinberger et al., which is assigned to Graco Minnesota Inc. Spray tips suitable for use with the present invention include conventional spray tip designs, such as are described in U.S. Pat. No. 3,955,763 to Pyle et al., which is assigned to Graco Minnesota Inc.

FIG. 10A shows a perspective view of stand unit airless spraying system 202 in which a wobble assembly of the present invention is used. System 202 includes housing 204, stand 206, sprayer 208, pumping mechanism 210, suction tube 212 and spray tube 214. A drive element (not shown) is disposed within housing 204 and is connected to pumping mechanism 210 through a wobble assembly (not shown). Sprayer 208 can be connected to pumping unit 210 with spray tube 214. Stand 206 is configured to be positioned atop a fluid container such that suction tube 212 can be positioned within the fluid container. Thus, by activation of pumping mechanism 210 by the drive unit and wobble assembly, fluid from the container is pressurized for dispensing with sprayer 208.

FIG. 10B shows an exploded view of stand unit airless spraying system 202 of FIG. 10A. System 202 includes housing 204, stand 206, pumping mechanism 210, suction tube 212, wobble assembly 215 and drive element 216. Housing 204 includes side halves 204A and 204B, and handle 204C. Stand 206 comprises base 206A for mounting on top of or being positioned around a fluid container, and neck 206B for connecting to housing 204. Pumping mechanism 210 includes piston 217, which includes socket 218, relief valve 219, outlet stem 220 and cylinder block 222. Wobble assembly 215 includes pin 224, connecting rod 225, which includes yoke 226 and ball 227, and gear 228. Drive element 216 includes motor 230, drive shaft 232, bushing 234 and drive block 236.

Outlet stem 220 connects to sprayer 208 through spray tube 214 (FIG. 10A). Sprayer 208 (FIG. 10B) includes a spray nozzle valve similar to what is described with respect to FIGS. 8 and 9. Suction tube 212, which in the embodiment shown comprises a plurality of tubes, connects to an inlet port in cylinder block 222. Relief valve 219 is connected to cylinder block 222 and is in fluid communication with outlet stem 220. Piston 217 is inserted into a piston cylinder within cylinder block 222, the cylinder being in fluid communication with the inlet port and outlet stem 220. Wobble assembly 215 connects piston 217 to drive element 216. Ball 227 of connecting rod 226 connects to socket 218 of piston 217. Connecting rod 225 is disposed around pin 224, which extends into drive block 236. Gear 228 is connected to pin 224 and driven by drive element 216. Motor 230 of drive element 216 couples to drive block 236. Bushing 234 supports drive shaft 232 in drive block 236. Drive shaft 232 includes gear teeth that mesh with gear 228. Thus, rotation of drive shaft 232 induces reciprocating motion of piston 217, similarly to what is described with respect to FIGS. 6A and 6B.

Figure 11:
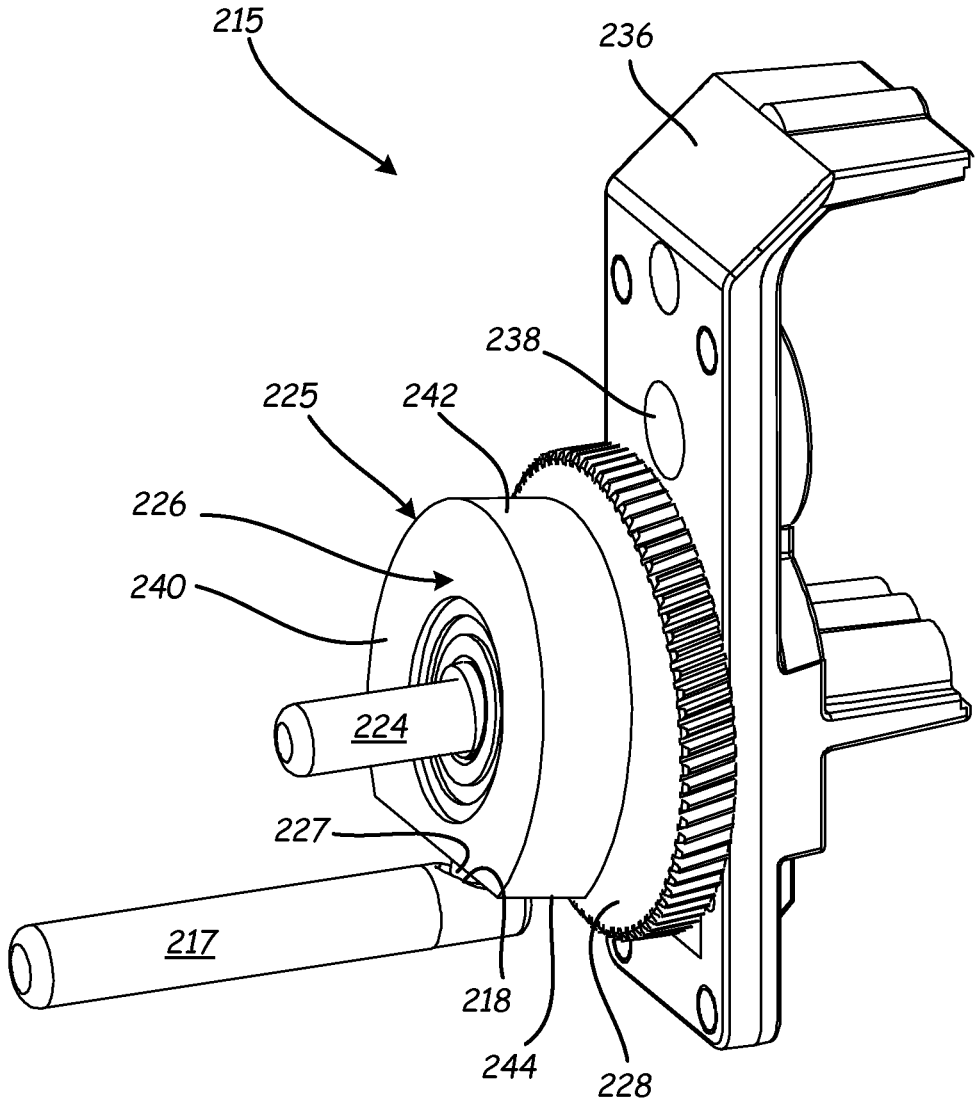
FIG. 11 shows a perspective view of a wobble assembly used in the systems of FIGS. 10A and 10B having a connecting rod with a truncated shape.

FIG. 11 shows a perspective view of wobble assembly 215 used in the system of FIGS. 10A and 10B. Wobble assembly 215 includes connecting rod 225, which includes yoke 226 and ball 227. Wobble assembly 215 also includes piston 217, pin 224, gear 228 and drive block 236. Pin 224 extends from drive block 236. A hub having a land is disposed upon pin 224 similar to FIGS. 6A and 6B Likewise, a bearing assembly upon which the yoke 226 is fit is disposed on the land. Drive shaft 232 (FIG. 10B) extends through hole 238 in drive housing 236 to engage gear 228. As previously explained, rotation of pin 224 causes yoke 226 to wobble such that piston 217 is reciprocated.

In the embodiment of FIG. 11, yoke 226 is truncated where ball 227 is positioned. In particular, yoke 226 comprises a circular body having flat front surface 240 and a flat back surface (not shown). Yoke 226 also has arcuate outer surface 242 and an arcuate inner surface (not shown). A portion of arcuate outer surface 242 is truncated, or planed, to form surface 244. Surface 244 shortens the height of connecting rod 225 such that yoke 226 fits into smaller areas within system 202 (FIG. 10B). For example, the height of the bottom portion of front surface 240 is decreased. Additionally, surface 244 moves the center of piston 217 to a balanced position. In particular, the tip of ball 227 is moved to where the outer perimeter of front surface 240 would be if perfectly round, without truncation. This helps balance reciprocation of yoke 226 when the upper portion of front surface 240 is used to advance a piston in addition to ball 227 advancing a piston, similar to that shown in FIG. 7.

FIGS. 12-14 show other embodiments of wobble assemblies suitable for use in system 202 of FIGS. 10A and 10B, with like features and components having the same reference numerals. However, such wobble assemblies may also be used in system 10 of FIGS. 2-4.

FIG. 12 shows a cross-sectional view of wobble assembly 246, which includes pin 248 and hub 250 that support connecting rod 252 and bearing assembly 254. Wobble assembly 246 is supported between cylinder block 222 and drive block 236 using bushing 256 and bearing 258, respectively. Bushing 234 supports drive shaft 232 in drive block 236 such that shaft 232 engages gear 228. Piston 217 is positioned within cylinder block 222 and supported by bushing 260 such that ball 227 of connecting rod 252 engages socket 218 of piston 217. Rotation of drive shaft 232 causes pin 248 and hub 250 to rotate. Wobble assembly 246 uses a pin and hub configuration similar to that of FIGS. 6A and 6B, wherein hub 250 includes land 264 with a bearing surface, a gear surface and a bushing surface. However, hub 250 includes a socket, rather than a through-bore, such that pin 248 does not extend through hub 250. This facilitates easy assembly of wobble assembly 246 because pin 248 does not need to be precisely aligned with hub 250. Together, pin 248 and hub 250 comprise a shaft that rotates to cause connecting rod 252 to reciprocate piston 217.

FIG. 13 shows a cross-sectional view of wobble assembly 266, which includes hub end 268, hub end 270 and dowel 272 that support connecting rod 274 and bearing assembly 276. Wobble assembly 266 is supported between cylinder block 222 and drive block 236 using bushing 278 and bearing 280, respectively. Wobble assembly 266 functions similarly to that of wobble assembly 246, for example, but is assembled from different components. In particular, hub ends 268 and 270 include sockets 282 and 284, respectively, which receive dowel 272. Sockets 282 and 284 have axes that are offset from the axis of rotation of hub ends 268 and 270. As such, dowel 272 forms a land upon which to support bearing assembly 276 to reciprocate piston 217. The embodiment of FIG. 13 allows different manufacturing and assembly techniques to be used to produce a shaft for the wobble assembly.

FIG. 14 shows a cross-sectional view of wobble assembly 286, which includes shaft 288 that supports connecting rod assembly 290. Shaft 288 is supported along axis $A_1$ by bushing 292 and bearing 294. Wobble assembly 286 functions similarly to that of wobble assemblies 246 and 266, but is comprised of a single-piece shaft in which hub 296 and land 298 are integrated. Furthermore, wobble assembly 286 illustrates an embodiment where two pistons (piston 300 and piston 302) are rigidly driven by connecting rod assembly 290, and in which two sets of bearings (bearing set 304 and bearing set 306) are integrated into connecting rod assembly 290.

Connecting rod assembly 290 includes yoke 307, ball 308 and ball 310. Yoke 307 comprises a ring-like structure having an outer diameter surface from which balls 308 and 310 extend. Balls 308 and 310 are diametrically opposed such that they are one-hundred-eighty degrees apart on the circumference of yoke 307. Balls 308 and 310 connect to sockets 312 and 314, respectively, to couple to pistons 300 and 302. Pistons 300 and 302 are disposed within pumping chambers inside a cylinder block (not shown) along axes $A_2$ and $A_3$, respectively. Yoke 307 also includes an inner diameter surface in which bearing raceways for bearing sets 304 and 306 are formed. The raceways comprise shaped troughs in which ball bearings of bearing sets 304 and 306 can role.

Shaft 288 is inserted into bearing sets 304 and 306 to support connecting rod assembly 290. Hub 296 includes inner raceway troughs for ball bearings of bearing sets 304 and 306. The inner raceways are disposed on land 298 of hub 296. Land 298 is oriented along axis $A_4$, which extends through yoke 307. Axis $A_4$ is tilted with respect to axis $A_1$ of shaft 288 at angle $\alpha$ to produce wobble effect when shaft 288 is rotated. Drive shaft 232 extends through drive block 236 along axis $A_5$ to engage gear 228. As hub 296 rotates along axis $A_1$, axis $A_4$ of land 298 orbits axis $A_1$ to cause yoke 307 to wobble. Thus, pistons 300 and 302 are reciprocated out of phase along axes $A_2$ and $A_3$, respectively.

Axis $A_1$ of shaft 288, axis $A_2$ of piston 300, axis $A_3$ of piston 302 and axis $A_5$ of drive shaft 232 are co-planar and parallel. In other embodiments the axes of pistons attached to yoke 307 are not co-planar with axis $A_1$ and axis $A_5$. For example, three pistons spaced one-hundred-twenty degrees apart along the circumference of yoke 307 may be used. Likewise, axis $A_5$ of shaft 232 need not be in the same plane as axes $A_1$-$A_3$. For example, shaft 232 may be offset from shaft 288 to accommodate gear reducing mechanisms. However, for packaging, alignment, balance and vibration advantages, it is desirable to have axes $A_1$, $A_2$, $A_3$ and $A_5$ co-planar and parallel. Axis $A_4$ of land 298 is, however, oblique and out-of-plane to the other axes in order to achieve the wobbling effect.

The wobble assemblies of the present invention transfer power from a drive element to a pumping mechanism in a compact manner to facilitate packaging in portable airless spray systems. The wobble assembly also produces efficient power transfer such that high pressures can be generated to produce highly atomized sprays. The wobble assemblies can be produced in a variety of ways utilizing a minimal number of components. Each of the components can be produced using inexpensive manufacturing processes. The components are also easily assembled. Thus, the wobble assemblies can be produced with minimal cost and time such that large-scale production of portable airless sprayers is feasible.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A fluid dispensing device comprising:
- a housing body;
- a reciprocating piston fluid pump having a first piston disposed within a first pumping chamber inside the housing body;
- a primary drive element coupled to the housing body to provide a rotary input;
- a wobble assembly connecting the primary drive element to the reciprocating piston fluid pump to convert the rotary input into reciprocating input to the first piston, the wobble assembly comprising:
  - a shaft disposed within the housing along a drive axis of rotation and configured to receive the rotary input from the primary drive element;
  - a land disposed about the shaft to surround the drive axis of rotation, the land having a cylindrical surface disposed about a wobble axis offset from the drive axis of rotation;
  - a connecting rod mounted on the land and connected to the first piston;
  - a bearing assembly disposed between the land and the connecting rod; and
  - an input gear disposed about the shaft to receive input from the primary drive element; and
- a spray tip connected to the first pumping chamber.

2. The fluid dispensing device of claim 1 and further comprising:
- a first bearing disposed about a first end of the shaft; and
- a second bearing disposed about a second end of the shaft, wherein the input gear is disposed axially between the bearing assembly and the second bearing.

3. The fluid dispensing device of claim 1 wherein the bearing assembly comprises:
- an inner race mounted to the land;
- an outer race mounted within the connecting rod; and
- a set of rolling element bearings configured to rotate between the inner and outer races.

4. The fluid dispensing device of claim 1 wherein the bearing assembly comprises first and second sets of rolling element bearings configured to rotate between the land and the connecting rod.

5. The fluid dispensing device of claim 1 wherein the shaft includes a pin having a first end and a second end.

6. The fluid dispensing device of claim 5 wherein the shaft further comprises:
- a hub comprising:
  - a first end having the land and mounted to the second end of the pin; and
  - a second end extending axially from the second end of the pin.

7. The fluid dispensing device of claim 6 wherein the pin extends through the first end and the second end of the hub.

8. The fluid dispensing device of claim 6 wherein the pin and the hub of the shaft and the land are formed of a single solid integrated piece.

9. The fluid dispensing device of claim 8 wherein the bearing assembly comprises:
- an inner race formed out of an outer surface of the land;
- an outer race formed out of an inner surface of the connecting rod; and
- a set of rolling element bearings configured to rotate between the inner and outer races.

10. The fluid dispensing device of claim 5 wherein the shaft further comprises:
- a hub comprising:
  - a first half having a first socket connected to the first end of the pin; and
  - a second half having a second socket connected to the second end of the pin;
  - wherein the first and second sockets are oriented along the wobble axis such that the pin defines the land.

11. The fluid dispensing device of claim 1 wherein the connecting rod comprises:
- a yoke concentrically disposed about the bearing assembly; and
- a ball extending from the yoke and connected to a first socket in the first piston.

12. The fluid dispensing device of claim 11 wherein the yoke is truncated where the ball extends from the yoke.

13. The fluid dispensing device of claim 11 wherein the reciprocating piston fluid pump comprises a second piston disposed within a second pumping chamber.

14. The fluid dispensing device of claim 13 wherein the yoke includes a front surface for pushing against a rear end of the second piston to advance the second piston into the second pumping chamber.

15. The fluid dispensing device of claim 13 wherein the connecting rod includes a second ball extending from the yoke and connected to a second socket in the second piston.

16. The fluid dispensing device of claim 13 wherein the first and second pistons engage the connecting rod such that the pistons are configured to reciprocate out of phase.

17. The fluid dispensing device of claim 1 wherein:
- the drive axis of rotation, a central axis of the drive element and a central axis of the first piston are coplanar and parallel.

18. The fluid dispensing device of claim 1 wherein the housing body comprises:
- a portable hand-held unit having:
  - a pistol grip handle;
  - a container lid having an inlet for receiving a fluid source and connecting to an inlet of the pumping chamber; and
  - a spray tip port having an outlet connected to an outlet of the pumping chamber through the spray tip.

* * * * *